United States Patent [19]

Tenconi

[11] Patent Number: 4,646,542

[45] Date of Patent: Mar. 3, 1987

[54] DEVICE FOR THE PASSING OF THE STITCH FROM A NEEDLE FOR THE FORMING OF PLAIN KNITTING TO A NEEDLE FOR THE FORMING OF PURL KNITTING AND VICE VERSA, IN A KNITTING MACHINE AND THE LIKE

[75] Inventor: Riccardo Tenconi, Varese, Italy

[73] Assignee: Mec-Mor S.p.A., Induno Olona, Italy

[21] Appl. No.: 879,851

[22] Filed: Jun. 27, 1986

[30] Foreign Application Priority Data

Jul. 4, 1985 [IT] Italy ..... 21432 A/85

[51] Int. Cl.[4] ..... D04B 9/22

[52] U.S. Cl. ..... 66/24; 66/95; 66/121

[58] Field of Search ..... 66/121, 123, 70, 64, 66/73, 24, 63, 67, 78, 115

[56] References Cited

U.S. PATENT DOCUMENTS

| | | | |
|---|---|---|---|
| 2,622,421 | 12/1952 | Minton | 66/95 |
| 2,626,515 | 1/1953 | St. Pierre | 66/95 |
| 2,997,865 | 8/1961 | Philip | 66/24 |
| 4,580,419 | 4/1986 | Vincoli | 66/123 |
| 4,607,504 | 8/1986 | Vincoli | 66/115 X |

*Primary Examiner*—Ronald Feldbaum

*Attorney, Agent, or Firm*—Guido Modiano; Albert Josif

[57] ABSTRACT

The device comprises a small plate elastically flexible, longitudinally flanked by a needle for plain knitting, or purl knitting, and movable in a direction longitudinal with respect to it. The needle has on one of its sides an inclined area with which at least one inclined area engages, defined by a bend of the small plate at the moment of its motion relatively to the needle. In this manner an elastic flexing of the small plate is obtained moving away from the needle which defines a loop within which a needle for purl or plain knitting can be inserted, in order to transfer a loop of knitting retained around the loop.

11 Claims, 16 Drawing Figures

Fig. 1
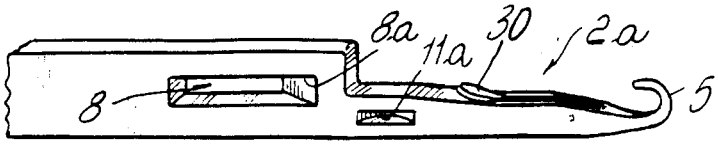
Fig. 2
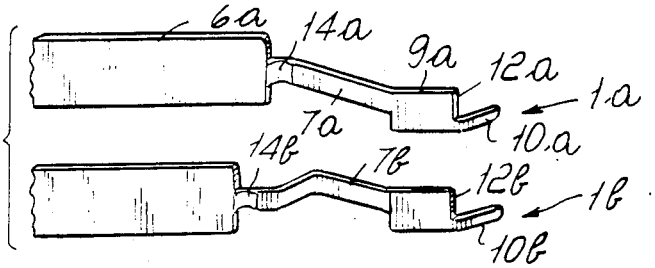
Fig. 3
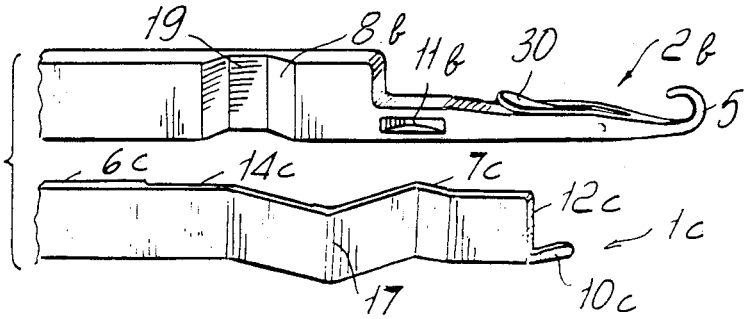
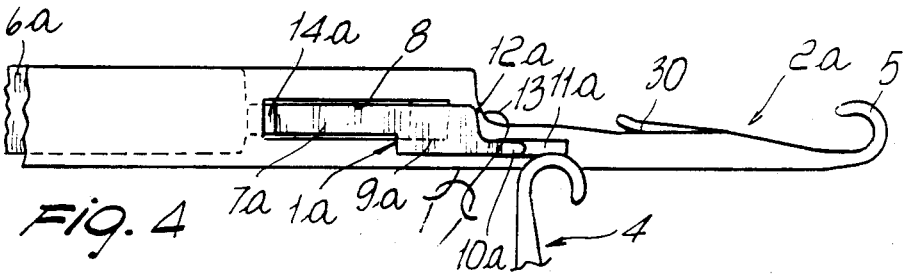
Fig. 4
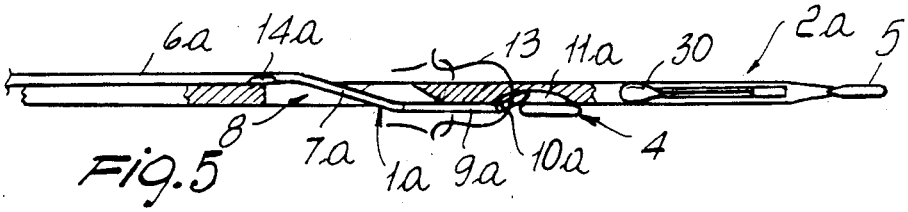
Fig. 5

DEVICE FOR THE PASSING OF THE STITCH FROM A NEEDLE FOR THE FORMING OF PLAIN KNITTING TO A NEEDLE FOR THE FORMING OF PURL KNITTING AND VICE VERSA, IN A KNITTING MACHINE AND THE LIKE

BACKGROUND OF THE INVENTION

The present invention relates to a device for the passing of the stitch from a needle for the forming of plain knitting to a needle for the forming of purl knitting, and vice versa, in a knitting machine and the like.

In the field of knitting machines and the like devices are known for the transfer of one or more stitches, or loops, from needles which form plain knitting to needles which form purl knitting in order to obtain particular knitting patterns.

In particular in knitting machines with a cylinder and platen, said devices are essentially composed of a shaped small plate associated with the side of a first needle for the forming of plain knitting, respectively purl. The small plate has its end opposite to the point of the needle rigidly associated with the side of the needle, whereas the other end is accommodated in a seat defined on the side of the needle. Said small plate is elastically flexible and defines together with the side of the needle a loop in which a second needle may be inserted for the forming of purl knitting, respectively plain, to hook onto the last loop formed by the first needle which is retained by a shoulder provided on the first needle, around the loop.

In practice the advancement of the first needle causes the sliding of the loop along its stem, the tab of the needle is opened by the loop which is retained by the shoulder of the needle on the loop in which the second needle penetrates. The subsequent return of the first needle causes the hooking of the loop by the second needle and the exit thereof from the loop with an elastic flexing of the small plate.

In knitting machines with not high refinement values, instead of using a small plate associated with the side of the needle, a needle is used with a hollow on a side in which can be inserted the needle which must receive the loop.

With these kind of devices the passage is obtained of the last loop formed by a needle of the cylinder to a needle of the platen and vice versa, thus obtaining a change in stitch from plain knitting to purl knitting or vice versa.

Said known types of device, though they obtain the transfer of the stitch from the plain knitting to the purl knitting, are not however free from disadvantages.

In particular in case of high refinements, a difficulty is encountered in the passing of the stitch since the small plate must be extremely flexible in order to be contained within the grooves of the cylinder, or of the platen, with the needle to which it is fixed and this great flexibility does not allow for a widening of the loop sufficient to allow for the insertion of the needle which must receive the loop, with consequent breakage or loss of the yarn.

This fact is all the more evident the more the yarn is stiff, such as, for example, during the knitting of cotton yarns.

Furthermore, since the small plate, when accommodated within the groove, is compressed between the side of the needle and the side of the groove, there are unavoidable problems of wear even during normal knitting, which affect the lifespan of the small plate.

Problems of wear are also found on the point of the needle which receives the loop for the friction which occurs, when the stitch is hooked and slipped off the needle which casts away the loop, between the needle which receives the loop and the point of the small plate which is opened by the needle.

In the case of not high refinement, there are problems of wear for the interference of the needle which casts away the loop with the needle which receives it; said interference causes the elastic deformation of the needles.

Another disadvantage is due to the fact that, in order to perform the transfer of the loop, it is necessary to make the needle which casts away the loop come out of the groove of the platen, or of the cylinder, of an amount far greater than that required by normal knitting. This fact implies that, in a circular knitting machine a special sector is provided for performing this operation, in which sector yarn-guides are absent in order to avoid interference with the points of the needles. Furthermore, the small plate with the loop determines a width of the groove which causes an excessive slack of the needle, which is fully disadvantageous for the precision of the knitting.

From U.S. Pat. No. 2,040,319 is known a device constituted by a small plate which flanks longitudinally a first needle, which works plain or purl, and accommodated with the same in a same groove of the cylinder of the needles or of the platen. The side of the needle facing the small plate has a shaped profile, which can be associated with a tooth defined on a portion of the small plate in such a way that a longitudinal sliding of the small plate relatively to the needle causes the moving away of a section of the end of the small plate orientated towards the point of the needle in order to define a loop in which a second needle can be inserted, which needle knits purl, or plain, so as to take the last loop formed by the first needle which is appropriately retained around the loop.

Such a kind of device, though it overcomes the disadvantages denoted by the previously described types, presents in turn some disadvantages.

One of these is due to the fact that the tooth of the small plate is in contact with the shaped profile of the needle with a reduced surface, and therefore relatively high stresses occur, which bring about a rapid wear of the point of the tooth, in particular in machines with high operating speeds. Furthermore, due to the fact that the tooth is defined on a portion of the edge of the small plate, there may occur, during the relative sliding of small plate and needle, an accidental slippage in a transverse direction of the small plate, with a consequent disengagement of the tooth from the shaped profile of the needle, in particular in the case of scarcely elastic yarns.

SUMMARY OF THE INVENTION

The specific aim of the present invention is to obviate the above described disadvantages, by providing a device for the passing of the stitch, or loop, from a needle for plain knitting to a needle for purl knitting in a knitting machine and the like even in the case of the use of scarcely elastic yarns and with high operating speeds.

Within the scope of this aim, an object of the invention is to reduce the occurrence of wear both of the needles and of the plates.

Another object of the invention is to provide a device which presents a high reliability and precision during the passing of the stitch.

This aim, as well as these and other objects which will become apparent hereinafter, are achieved by a device for the passing of the stitch from a needle for the forming of plain knitting to a needle for the forming of purl knitting and vice versa in a knitting machine and the like, comprising a small plate longitudinally flanking a first needle for the forming of plain knitting, respectively purl, said small plate having at least a portion thereof slideably engageable with a shaped profile of said first needle such that a preset sliding of said small plate relatively to said first needle, in a parallel manner to the longitudinal axis of said first needle, determines the elastic moving away of a section of the end of said small plate, orientated towards the point of said first needle, from the side of said first needle in order to define with said side a loop in which a second needle can be inserted for the forming of purl knitting, respectively plain, there being provided means for the retention of the last loop of knitting formed around said loop for the passing of said last loop from said first needle to said second needle and operating means which can be activated as required to impart said preset sliding to said small plate relatively to said first needle, characterized by the fact that said shaped profile of said first needle is substantially composed of a hollow defined on the side of said first needle orientated towards said small plate, said hollow presenting transversely a slanted area, with respect to the plane defined by said side, which can be coupled with a correspondingly inclined area defined by at least one bending of said small plate for an elastic flexing of said portion of the end of said small plate, there being furthermore provided means for limiting the elastically flexible portion of said small plate.

BRIEF DESCRIPTION OF THE DRAWINGS

Further characteristics and advantages of the invention will become apparent from the following description of some preferred, but not exclusive, embodiments, of the device according to the invention, which are illustrated by way of example only in the accompanying non-limitative drawings, where:

FIG. 1 is a perspective view of part of the first needle according to the invention in a first embodiment;

FIG. 2 illustrates two embodiments of the small plate according to the invention which can be placed adjacent to the first needle illustrated in FIG. 1;

FIG. 3 is a perspective view of a second embodiment of the first needle according to the invention with the relative small plate;

FIGS. 4 to 9 are side elevation and top plan views partially cross-sectioned to make apparent the operation of the device according to the invention with the first needle represented in the first embodiment coupled with one of the small plates of FIG. 2;

DESCRIPTION OF THE PREFERRED EMBODIMENTS

Figure 6:
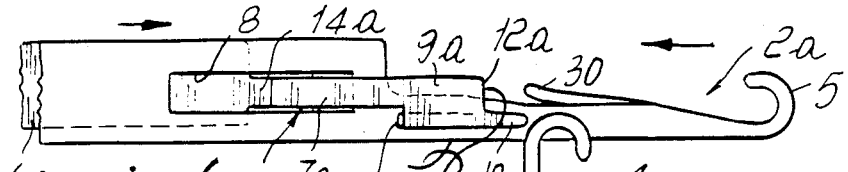
Figure 7:
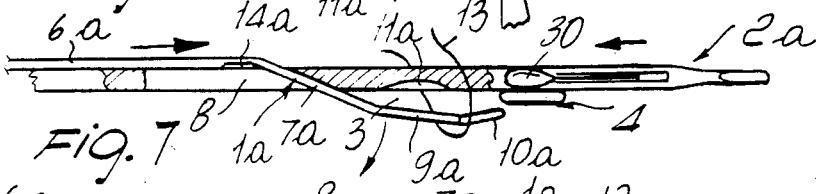
Figure 8:
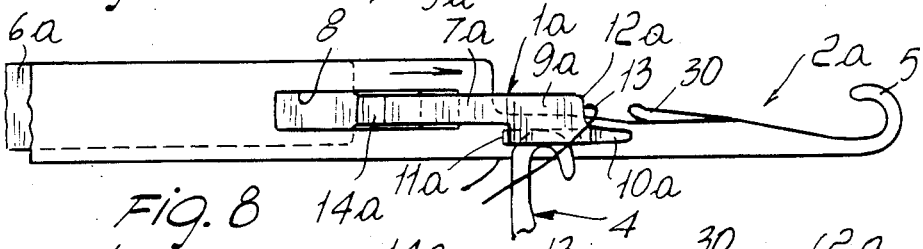
Figure 9:
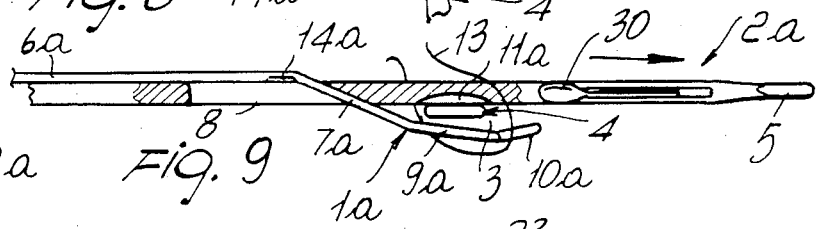

With reference to the drawings, the device according to the invention comprises a small plate, indicated in the various embodiments with the numerals 1*a*, 1*b*, 1*c* which is placed slideably adjacent to a first needle, respectively 2*a*, 2*b* which can be, as an example, a needle of the cylinder in the case of plain knitting or a needle of the platen in the case of purl knitting, if the device is used on knitting machines with a cylinder and a platen.

The small plate has an area which is engageable with a shaped profile defined on the first needle in such a way that a preset sliding of the small plate relatively to the first needle, in a direction parallel to its longitudinal axis, determines a moving away of a portion of the small plate from the side of the needle, so as to define a loop 3 in which a second needle 4 can be inserted. This second needle will be held by the cylinder if the first needle is held by the platen, or by the platen if the first needle is held by the cylinder.

In the first embodiment the small plate 1*a*, which can be coupled with a needle 2*a*, is provided, starting from its end which is positioned at the opposite part of the point 5 of the needle, with a first flat section 6a which is rested on a side of the needle. After this flat section, the small plate is provided with a portion 7*a* inclined with respect to the first section which passes through an opening 8 defined on the stem of the needle 2*a* and subsequently presents a further section 9*a* parallel to the first section, destined to rest on the other side of the needle 2*a*. The small plate 1*a* ends with a point 10*a* bent towards the side of the needle which can be accommodated in a hollow 11*a* provided correspondingly on the side of the needle 2*a*.

At the opening 8 is defined a hollow with a wall 8*a*, which delimits the opening 8 in the direction of the point of the needle 2*a*; said wall 8*a* is composed of an inclined area with respect to a plane defined by a side of the needle, which constitutes the shaped profile of the needle.

The small plate 1*a* is in an elastically flexible material, for example spring steel, and the section 7*a*, with the small plate coupled to the needle, has an inclination with respect to the side of the needle 2*a* smaller than the inclination of the wall 8*a*, in such a way that the sliding of the section 7*a*, which constitutes the inclined area according to the invention, on the wall 8*a* in the direction of the point of the needle 2*a* obtains an elastic flexing with a moving away of the section 9*a* and of the point 10*a* of the small plate from the side of the needle 2*a* to define the loop 3 open towards the point 5 of the needle 2*a*.

The point 10*a* of the small plate has a height smaller than the height of the last section 9*a* so that at the end of this last section a shoulder 12*a* is defined, which constitutes the means for retaining the last loop 13, formed by the needle 2, around the loop 3 in order to allow the second needle 4 to hook this loop.

Advantageously, in order to delimit the part of the end of the small plate which is to flex, before the section 7*a* is provided a weakening 14*a* of the thickness of the small plate. In this way the flexing does not reach the first section of the small plate and obtains an excellent dilation of the loop. The details of the small plate 1*a*, that is the point 10*a*, the shoulder 12*a* and the weakening 14*a* are present in all the embodiments and are indicated respectively: the points at 10*b*, 10*c*, the shoulders at 12*b*, 12*c*, the weakenings in thickness at 14*b* and 14*c*.

In the same manner in all the needles a hollow is present, respectively 11*a*, 11*b* destined to accommodate the point of the small plate. For the parts of the needles shaped in known manners an identical reference numeral will be used on occasion for the two embodiments.

With a needle shaped like needle 2*a* can also be coupled the small plate 1*b* of the second embodiment which, contrary to the small plate 1*a*, does not pass through the opening 8, but leans on only one side of the needle 2*a*.

Analyzing this embodiment more particularly, it can be noted that the small plate 1*b* has an inclined portion 7*b* similar to the inclined portion 7*a* of the small plate 1*a* and in order to bring said inclined portion 7*b* into contact with the wall 8*a* of the opening 8, a simple bending of the stem of the small plate has been performed.

The third embodiment illustrates a small plate 1*c* with several bending points. More precisely, after the first section 6*c* destined to lean on the side of the needle 2*b*, with which can be coupled the small plate 1*c*, two bends are provided which define a protrusion 17 which is engageable, when the small plate 1*c* is not operated, in a hollow 18*a* defined on the side of the groove 18, of the small plate or of the cylinder of the machine, in which are inserted the needle 2*b* and the respective small plate 1*c*.

Continuing in the direction of the point 10*c* of the small plate 1*c*, there is a third and a fourth bend, which define the inclined area 7*c* which is engageable with an inclined area 8*b* defined by a hollow 19 on the side of the needle 2*b*. This inclined surface 8*b* has the same function of the wall 8*a* of the needle 2*a*.

The device according to the invention furthermore includes operating means which can be activated as required for sliding the small plate relatively to the first needle.

The small plate, in all the embodiments, has, proximate to its end opposite with respect to the point, a heel 20 which, similarly to heels 21 of the first and of the second needle, can be operated by cams accommodated in the skirt of the cylinder and of the platen of the machine.

In the drawings is illustrated the development plane of a sector of the skirt of the cylinder of a knitting machine provided with cams for performing the casting off of the loop from needles of the cylinder to needles of the platen and for performing the receiving of the loop on needles of the cylinder from needles of the platen.

More precisely there is a first cam 23 which is engageable to the heel 20 of the small plate, a second cam 24 engageable to the heel 21 of the first needle, or to the needle when it must cast away the loop, and a third cam 25 engageable to the heel of the second needle, or to the needle when it must receive the loop.

Obviously, a same needle can operate both for leaving and for receiving the loop, the only difference is that when it casts away the loop the small plate next to it is activated, whereas when it receives it the small plate is not activated.

The skirt of the platen is not illustrated as the cams destined for the operation of the needles and of the small plates have substantially the same conformation as the cams 23, 24 and 25 and like these they have the possibility of being flush-located or extracted to disengage or engage to the heels of the needles or of the plates.

The first cam 23 is provided with a first ascending section 23*a*, a loitering section 23*b* and a descending section 23*c*.

The second cam 24 is provided with a first ascending section 24*a* which moves the first needle of an amount such that the heel of the small plate pulled by the needle can engage to the first cam 23, subsequently to this first section 24*a* there is a descending section 24*b* substantially concomitant with the ascending section 23*a* of the first cam 23. Subsequently there is a further ascending section 24*c* and finally a descending section 24*d*.

The third cam 25 has an ascending section 25*a* to carry the point of the second needle at the level of the hollow of the first needle and subsequently a second ascending section 25*b* to carry the point of the second needle thorugh the loop 3 to hook the loop.

The second cam 24, represented at the level of the heels of the needles, could in reality be accommodated in an inferior section of the skirt and control the heels of the selectors which push the needles which must cast away the loops.

The operation of the device according to the invention is the following.

With reference to FIGS. 5 to 10, supposing one must shift the loop 13 from a first needle 2a positioned in the platen of a knitting machine to a second needle 4 operating in the cylinder, one can operate as follows.

On the skirt of the platen cams are activated which are similar to the first cam 23 and to the second cam 24, which control the small plate and the first needle, while on the skirt of the cylinder the third cam 25 is activated, which controls the second needle.

The first needle is taken externally to the platen beyond the hollow 11*a* so that the loop 13 to be shifted slides along the stem of the first needle past the tab 30. At this point the small plate is moved towards the point 5 of the needle, while the needle is moved backwards so that a combined effect is obtained which increases the relative shift between the small plate and the needle. The inclined area 7*a*, by sliding along the wall 8*a*, causes a deformation of the last section of the small plate which defines the loop 3 widening the loop 13 which is withheld on the loop by shoulder 12*a*.

Meanwhile the second needle has attained with its point the level of the hollow 11*a* so that it restrains with the back of its point the loops which precede the loop 13. At this point there is a slight advancement of the first needle which reduces the widening of the loop, slackening the loop 13, and a further ascending motion of the second needle which passes through the loop 3 and then through the loop 13.

The subsequent backward motion of the first needle and of the small plate achieves the abandoning of the loop 13 on the point of the second needle. It remains to be noted that at the moment of abandonment the second needle, in order to exit from the loop, does not touch the small plate.

With reference to FIGS. 11 to 16 the operation is shown of the small plate 1*c* with the first needle 2*b*.

The operation is substantially identical to the one previously described, with the difference that in normal knitting the small plate does not follow the needle in its knitting motion, since it is restrained by the protrusion 17 in the hollow 18*a*, but is only moved in the case in which the leaving of the stitch carried by the needle 2*b* is required.

Figure 10:
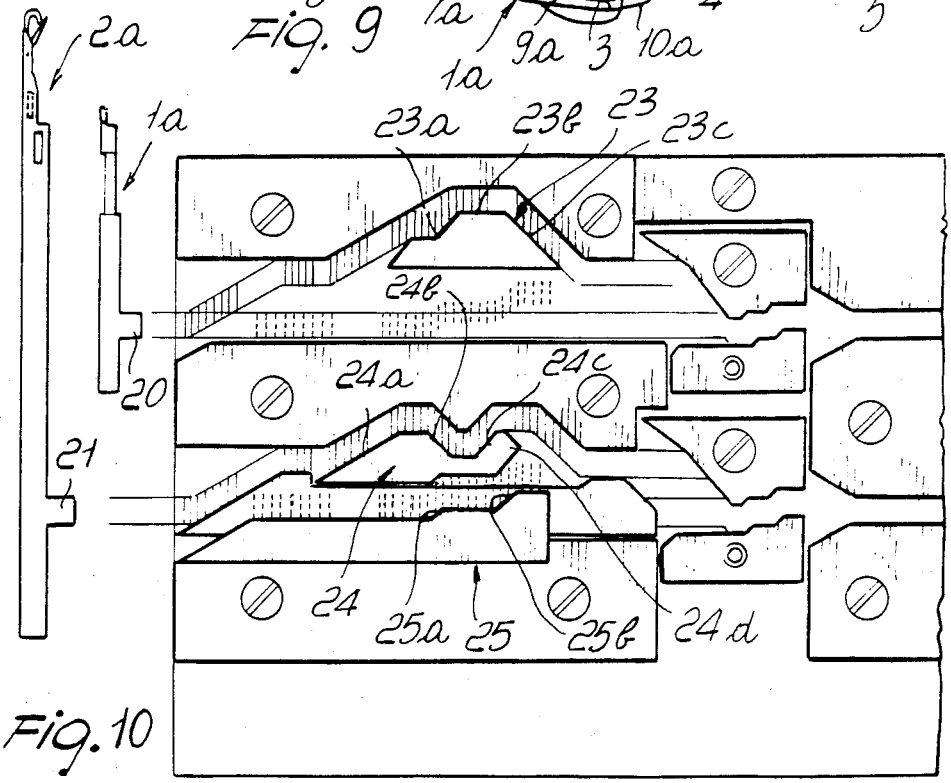
FIG. 10 is a schematic view of a portion of the skirt of the cylinder of a circular knitting machine with adjacent respectively a needle and a small plate according to the invention.
Figure 11:
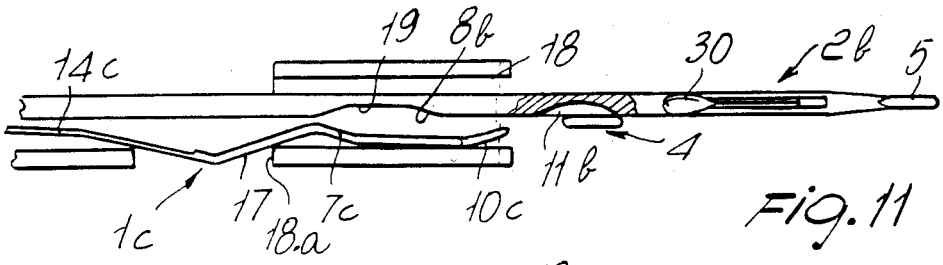
FIGS. 11 to 16 are top plan views and side elevation views partially cross-sectioned to make apparent the operation of the device according to the invention with a first needle in the second embodiment and the relative small plate.
Figure 12:
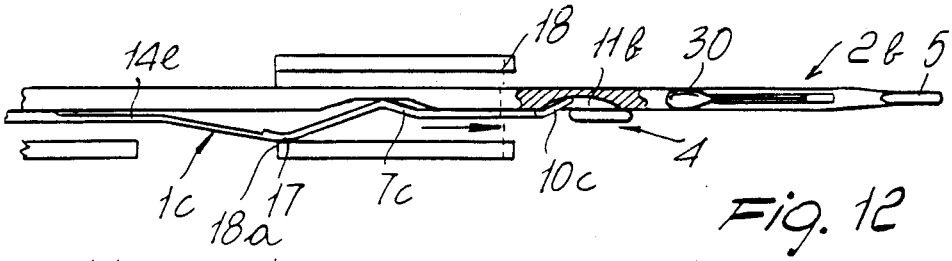
Figure 13:
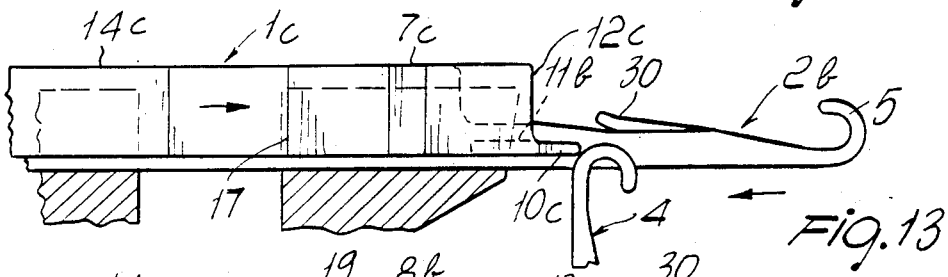
Figure 14:
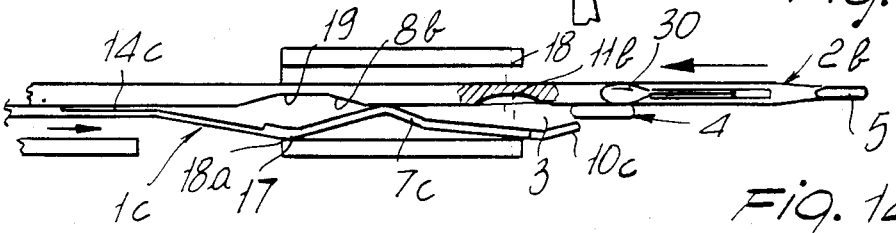
Figure 15:
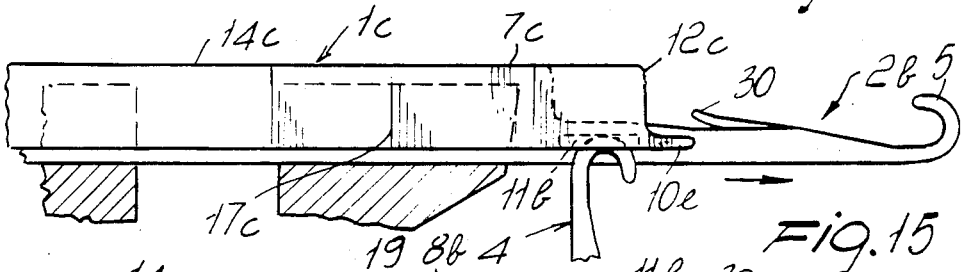
Figure 16:
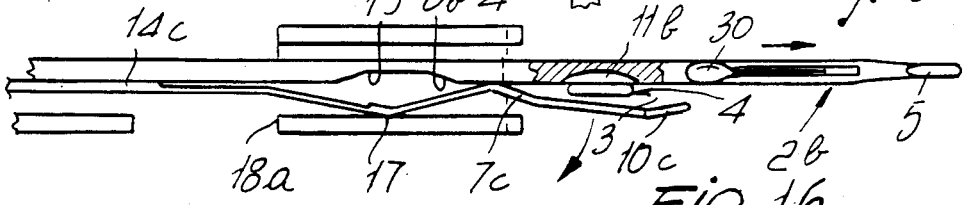

For descriptive completeness it must be said that in FIG. 10 have been represented the heels of the needle and of the small plate respectively with a continuous line in the case in which the needle of the cylinder must cast away the loop and with a discontinuous line in the case in which the needle in the cylinder must receive the point from a needle of the platen.

In practice it has been noted that the device according to the invention fully achieves the prefixed aim and objects, easily obtaining the passing of the stitch even with very high refinements and with scarcely elastic yarns due to the fact that the forces exchanged between the needle and the small plate occur in inclined areas with a relatively large surface which reduces the specific stresses and the possibility of accidental disengagement between small plate and needle even in the case of high machine operating speeds. Furthermore, again due to this fact, the wear is remarkably reduced of the small plate during its sliding relative to the needle.

Not least advantage is that of being capable of performing with the device according to the invention a casting away of the stitch from the plain knitting to the purl knitting with a section of the machine used for normal knitting, by virtue of the fact that the needle which must cast away the loop need not be extracted excessively from the relative groove.

The small plate in the first embodiment, furthermore, by passing through the needle, is maintained adherent to it, thus facilitating remarkably the assembly operations of the needles in the cylinder or platen grooves of the machine.

The small plate in the third embodiment, due to the fact that when it is not activated it is withheld within the relative groove, allows for a reduction of the noise level during the operation of the machine.

The device thus conceived is susceptible of numerous modifications and variations, all of which are within the scope of the inventive concept; furthermore, all the elements are replaceable with technically equivalent elements.

The device has been described for greater clarity by referring very often to a knitting machine with a cylinder and a platen, it remaining understood that a device of this kind can be easily employed even in rectilinear-type knitting machines.

In practice the material employed, as well as the dimensions, may be any according to the requirements and to the state of the art.

I claim:

1. Device for the passing of the stitch from a needle for forming plain knitting to a needle for the forming of purl knitting and vice versa, in a knitting machine and the like, comprising a small plate longitudinally positioned at the side of a first needle for the forming of plain knitting, respectively purl, said small plate having at least a portion thereof slideably engageable with a shaped profile of said first needle such that a preset sliding of said small plate relatively to said first needle, in a parallel manner to the longitudinal axis of said first needle determines the elastic moving away of a section of the end of said small plate, orientated towards the point of said first needle, from the side of said first needle to define with said side a loop in which can be inserted a second needle for the forming of purl knitting, respectively plain, there being provided means for the retention of the last loop of knitting formed around said loop for the passing of said last loop from said first needle to said second needle and operation means which can be activated upon request to impart said preset sliding to said small plate relatively to said first needle, said shaped profile of said first needle being substantially constituted by a hollow defined on the side of said first needle orientated towards said small plate, said hollow being transversely endowed with an area inclined with respect to the plane defined by said side, which can be coupled with an inclined area correspondingly defined by at least one bend in said small plate for an elastic flexing of said section of the end of said small plate, there being furthermore provided means for delimiting the elastically flexible section of said small plate.

2. Device according to claim 1, wherein said inclined area of said small plate has a smaller inclination with respect to the inclined area of said hollow.

3. Device according to claim 1, wherein said inclined area of said first needle is defined on the wall of the end orientated towards the point of said first needle of an opening defined on said first needle and crossed by said inclined area of said small plate.

4. Device according to claim 1, wherein on said side of said first needle is provided a hollow for accommodating the end of said small plate orientated towards the point of said first needle at the beginning of the engagement of said inclined area of said small plate with said shaped profile of the first needle.

5. Device according to claim 1, wherein said means for delimiting the elastically flexible section of said small plate are substantially composed of a weakening of thickness along the length of said small plate.

6. Device according to claim 1, wherein said means for retention are essentially composed of a shoulder provided proximate to the end of said small plate orientated towards the point of said first needle.

7. Device according to claim 1, wherein said small plate is provided at the opposite end with respect to the point of said first needle with a heel engageable with said operating means.

8. Device according to claim 7, wherein said operating means comprise a first cam accommodated in the skirt of the operating cams of said first needle, said cam being extractable for flush-fitting as required in said skirt to engage and disengage with said heel of said plate.

9. Device according to claim 1, wherein said operating means comprise a second cam accommodated in the skirt of the operating cams of said first needle, said cam being extractable or flush-fitting as required in said skirt to engage and disengage with the heel of said first needle or with a selector underlying said first needle.

10. Device according to claim 9, wherein said first cam has a section of its length acting on said heel of the small plate for a shifting of said small plate towards the point of said first needle, said section being proximate to a section of said second cam acting on said selector for a backward motion of said first needle.

11. Device according to claim 1, wherein said small plate has a bend defining a protrusion, with said small plate not activated, engageable in a hollow defined on the side of a groove accommodating said first needle and said small plate.

* * * * *